United States Patent [19]

Fikhte et al.

[11] 4,101,079

[45] Jul. 18, 1978

[54] BIOLOGICAL BALL MILL

[75] Inventors: Boris Abramovich Fikhte, Moscow; Grigory Aronovich Gurevich, Puschino Moskovskoi oblasti; Vyacheslav Mitrofanovich Ushakov, Puschino Moskovskoi oblasti; Viktor Sergeevich Polpudnikov, Puschino Moskovskoi oblasti, all of U.S.S.R.

[73] Assignee: Institut Biokhimii I Fiziologii Mikroorganizmov, Puschino Moskovskoi oblasti, U.S.S.R.

[21] Appl. No.: 720,616

[22] Filed: Sep. 3, 1976

Related U.S. Application Data

[63] Continuation of Ser. No. 580,686, May 23, 1975, abandoned.

[51] Int. Cl.[2] ..... B02C 23/36

[52] U.S. Cl. ..... 241/46.15; 241/171

[58] Field of Search ..... 241/46.11, 46.15, 46.17, 241/170, 171, 172, 184

[56] References Cited

U.S. PATENT DOCUMENTS

| | | | |
|---|---|---|---|
| 3,405,874 | 10/1968 | Brizon | 241/184 |
| 3,511,447 | 5/1970 | Brizon | 241/172 |
| 3,539,115 | 11/1970 | Woods | 241/46.15 |
| 3,713,593 | 1/1973 | Morris et al. | 241/184 |

FOREIGN PATENT DOCUMENTS

| | | | |
|---|---|---|---|
| 741,781 | 8/1966 | Canada | 241/171 |

*Primary Examiner*—Granville Y. Custer, Jr.

[57] ABSTRACT

A cylindrical milling chamber of a disintegrator is made in such a manner that the width thereof is substantially smaller than the diameter. An opening for feeding the material being disintegrated is provided at the center of one of the end walls of the milling chamber, and openings for discharging suspension of the disintegrated material are provided on the cylindrical surface of the milling chamber. At the center of the milling chamber there is provided an agitator for milling bodies mounted concentrically therewith. The milling bodies are made of a material having a density corresponding to the density of suspension of the material being disintegrated. The milling chamber considerably reduces the adverse effects of temperature and pressure on the material being disintegrated, such that overdisintegration of the material is eliminated. At the same time, the specific productivity of the disintegrator is improved by $10^2$ times.

6 Claims, 1 Drawing Figure

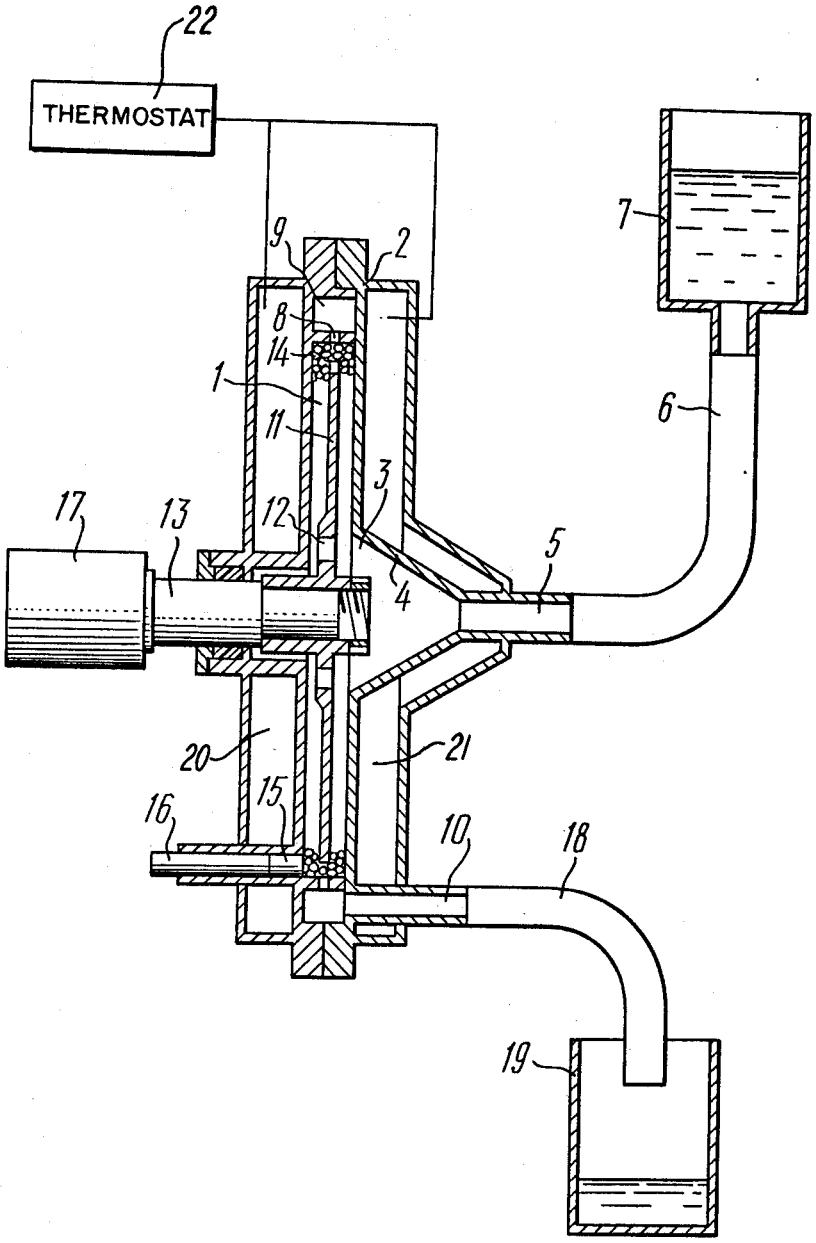
22
THERMOSTAT
7
9
2
8
14
1
11
6
3
17
13
12
5
4
20
21
16
15
10
18
19

BIOLOGICAL BALL MILL

The present application is a continuation of the parent application Ser. No. 580,686, filed May 23, 1975 now abandoned.

BACKGROUND OF THE INVENTION

The present invention relates to experimental and biological production technology, and more specifically to disintegrators.

The invention may be widely used for disintegrating in liquid media powers of natural and synthetic complex organic compounds such as biologically active compounds to obtain particles of less than 0.5μm; as well as for disintegrating plant, animal and microbic cells in biochemical and microbiological laboratories, and in the pharmaceutical, microbiological, food and paint-making industries.

There are presently known in the art disintegrators having a milling chamber filled with milling bodies comprising balls. Prior art disintegrators differ from each other in the means for agitating milling bodies and the material being handled. In some disintegrators, vibratory, jerking, orbital and other kinds of compound motion are imparted to the milling chambers for agitating milling bodies and the material being handled, while it is also known to provide high-speed and ultra-high speed vane-type agitators or multiple disc-type agitating rotors in the milling chambers.

Known disintegrators operate either in the intermittent loading unloading manner or continuously. Continuous disintegrators are provided with pumps for feeding the material to be treated under pressure into the milling chamber. All disintegrators have cooling systems. Continuous disintegrators manufactured by WAB company (Switzerland) covered by U.S. Pat. No. 3,536,266 using spherical glass milling bodies of 0.1–1.0 mm diameter differ from the above-described disintegrators in having a large volume of milling chambers and high productivity so that they may be commercially used. WAB company manufactures a range of modularized disintegrators with milling chambers having the volume of 0.3–0.6–5.0–50–200 1.

The disintegrator comprises a cylindrical milling chamber with a height-to-diameter ratio of about 4:1 having a cooling system. Openings for feeding and discharge of the material being disintegrated are made in the cylindrical surface of the milling chamber adjacent to the end walls. A multiple disc-type agitator is concentrically mounted within the chamber and is rotated by an electric drive. Spherical glass milling bodies are placed in the milling chamber and agitated by the multiple disc-type agitator. An external delivery pump feeds a suspension of the material being disintegrated into the milling chamber, pumps it through the layer of agitated milling bodies and expells the disintegrated material through the discharge opening from the milling chamber.

It should be noted that the term "suspension" implies herein a liquid, such as water containing particles of biological, microbiological or organic material.

The main disadvantage of the prior art disintegrator consists of an intensive wear on the walls of the milling chamber, and discs of the agitator and milling bodies which is due to a high hardness (7–8 points in the Knup scale) of glass milling bodies.

An intensive wear of the above-mentioned surfaces of the disintegrator is accompanied by a number of physical, chemical and mechanical phenomena adversely affecting the structure and properties of the material being handled, namely, (1) peptization of glass in a liquid medium used to transfer a material being disintegrated into the milling chamber;

(2) abrupt raise of local pressures and temperatures at points with the impact contact of glass milling bodies;

(3) formation of inclusions of ultrafine particles of glass and metal in the material being disintegrated:

(4) chemical reactions between the inclusion material of ultrafine particles and the material being disintegrated;

(5) change in pH of a suspension of the material being disintegrated;

(6) thermomechanical degrading of the material being disintegrated in the zone with impact contact of glass milling bodies.

The above-mentioned phenomena result in a material reduction of biological activity of the final microbic disintegrates, thermomechanical and chemical decomposition of powders of complex organic compounds being disintegrated and in contamination of the material being treated with glass and metal particles.

A substantial diasadvantage of the conventional disintegrator also consists in an inadaquate distribution of flows of the transporting liquid in the milling chamber resulting in the formation of large-volume stagnation zones between the discs of the agitator.

Stagnation zones reduce the effective volume of the milling chamber thereby diminishing the specific productivity of the disintegrator (per unit of volume of the milling chamber).

The stagnation zones result in an increased residence time of the material being treated in the milling chamber, and hence, in overdisintegration.

It is an object of the present invention to eliminate the above disadvantages.

The main object of the invention is to provide a disintegrator which is suitable for disintegrating biological and organic products (cells of microorganisms, animals and plants, biopolymers, complex organic compounds) without substantially reducing the biological activity and without any thermomechanical destruction of the final disintegrated products.

Another object of the invention is to provide a disintegrator which permits the disintegration of powdery organic products to a particle size of less than 0.5μm.

Still another object of the invention is to provide a disintegrator which disintegrates biological and organic products with their initial high purity remaining unchanged.

A further object of the invention is to provide a disintegrator having a productivity which is much greater than that of conventional apparatus of this type.

The invention consists of the provision for a disintegrator having the components so constructed as to enable uniform control of the intensity of mechanical action of the milling bodies on the material being treated over the entire volume of the milling chamber, whereby biological and organic products can be disintegrated at a high rate with their initial purity remaining at high level, while eliminating the thermomechanical destruction and any appreciable reduction of biological activity of the materials being treated.

SUMMARY OF THE INVENTION

The above objects are accomplished by providing disintegrator comprising a cylindrical milling chamber containing milling bodies and having openings for feeding and discharging suspension of the material being disintegrated. The end-walls of the chamber have cavities for liquid refrigerant circulation. An agitator is mounted at the center of the milling chamber concentrically there with. According to the invention, the width of the chamber is substantially smaller than the diameter thereof. The width of the chamber is the distance between its end-walls equal to the clearance between its internal interparallel surfaces of the chamber end-walls. Opening for feeding suspension of the material being treated is located at the center of one of the end walls of said chamber, and the openings for discharging suspension of the disintegrated material are arranged in the cylindrical surface of the chamber. The milling bodies are made of a material having a density equal or about equal to that of suspension of the material being treated.

The employment of the present disintegrator according to the invention makes it possible to reduce the residence time of the material being treated in the milling chamber to $5.10^{-2}$–1.0 s., thereby materially reducing any adverse effect of temperature on the material being disintegrated and enabling a considerable reduction of the risk of overdisintegration of the material. At the same time, the specific productivity of the disintegrator (per unit of volume of the milling chamber) is improved by $10^2$ times. The construction of the disintegrator is considerably simplified: no delivery pump is required, and at the same time, the capacity of the cooling system is reduced and effectiveness of cooling is increased.

The use of milling bodies having a density equal or about equal to that of the suspension of the material being disintegrated considerably diminishes forces acting on the milling bodies in the milling chamber, thereby reducing the thermomechanical degrading of the material being disintegrated.

The ratio of the width of the milling chamber to the diameter thereof is preferably from 1:10 to 1:50.

The provision of the milling chamber with the width diameter ratio of 1:10 to 1:50 allows reduction to a minimal volume of a batch of the material being treated to 50 $cm^3$ so that one and the same apparatus offers the advantages of a small laboratory disintegrator and high-performance commercial disintegrator. Furthermore, with the above-specified width diameter ratios for the milling chamber, the disintegrator is of the most simple structure, and its reliability is improved by $10^3$ times. The efficiency of cooling of the entire volume of the milling chamber according to the invention is considerably improved. Thus, the proposed ratio characterizes the milling chamber as a thin cylinder having a very small width. This results in that for a diameter of the milling chamber of approximately 0.2 to 0.3 m, its volume is very small, approximately 200 cu.cm, and this allows batches of 50 cu. cm. to be treated therein.

Due to this ratio, furthermore, the milling chamber has a very small width. With a one-disc agitator structure this ratio ensures a very small length of the shaft to which the agitator is secured. As a result there is practically no angular bending of the shaft during operation of the disintegrator, and the period of fault-free operation of an oil seal is prolonged considerably. The reliability of the disintegrator is thereby raised and its operation is highly stable.

According to the invention, it is also preferable that milling bodies be made of a chemically inert antifriction material.

The employment of milling bodies made of chemically inert antifriction materials enables:

(1) elimination of abrasion of the milling chamber and agitator surfaces, thereby preventing the material being disintegrated from being contaminated;

(2) reduction of pressure, frction and heat release in the zone of impact contact of milling bodies by hundreds of times, whereby the thermomechanical and chemical degrading of the material being disintegrated is materially diminished;

(3) material improvement of the efficiency of the disintegrator.

BRIEF DESCRIPTION OF THE DRAWING

Other objects and advantages of the present invention will become apparent from the following detailed description of the disintegrator according to the invention with reference to the accompanying drawing which shows a longitudinal section of the desintegrator.

DESCRIPTION OF THE PREFERRED EMBODIMENTS

The disintegrator according to the invention comprise a thermostatically temperature controlled milling chamber 1. Thermostatic control is obtained, for example, in conjunction with an external thermostat 22 by the circulation of a liquid cooling agent through cavities 20, 21 of bases of the chamber. The temperature is thereby held constant. The thermostat controls the temperature of the cooling agent circulating in the cavities 20 and 21. Due to the high heat conductivity of the metallic walls of the milling chamber, the temperature inside remains constant during operation of the disintegrator. The temperature in the milling chamber during operation of the disintegrator should be kept constant for producing highly conditioned products as thermosensitive materials are disintegrated. The milling chamber 1 is the main part of the disintegrator, wherein the disintegration of a material being treated takes place, such as disintegration of cortisone acetate having an initial dispersion of 10–100$\mu$m, of microorganisms (yeast Saccharomyces cerevisial).

The material used to make the inner surface of the milling chamber 1 should be chemically inert. It is possible for example to employ titanium-containing stainless steel.

The milling chamber 1 is of a cylindrical shape. We have found that, in order to provide for an optimal disintegration of the material being treated the ratio of the width of the milling chamber 1 to the diameter thereof should be such as to completely eliminate the formation of stagnation zones therein. Stagnation zones are spaces of the milling chamber where the flow of the working liquid is slowed down or moves in a closed circular path. These zones are formed, for example, in conventional ballistic disintegrators around the axis of the shaft of a multi-disc agitator.

In the present disintegrator using a one-disc agitator, a stagnation zone could be formed close to the center of the agitating disc. Due to the pump-like operation of the agitator rotating in the milling chamber at the specified width-to-diameter ratio, however, a stagnation zone is either eliminated completely or minimized to an infinitely small volume. Stagnation zones cannot be eliminated in the reference multi-disc disintegrators having a width-to-diameter ratio of the milling chamber of approximately 2:1, because these disintegrators cannot operate like pumps.

An optimal ratio of the width of the milling chamber 1 to the diameter thereof lies within the range from 1:10 to 1:50. A ratio exceeding 1:50 results in a lower structural strength of the disintegrator, while a ratio less than 1:10 stagnation zones may be formed in the milling chamber 1. Due to the dimensional proportioning of the milling chamber 1 according to the invention, its volume is considerably reduced its cooling is sharply enhanced and a residence time of the material being disintegrated in the milling chamber 1 is as short as 1.0–5×10 sec., which is sufficient for disintegration of the materials being handled to a particle size less than 0.5μm. The quantity 1.0–5.10 sec. is the duration of treatment of a material in the milling chamber of the disintegrator. It depends on the desired size of particles of the product: the smaller the size, the longer the duration of treatment. The duration of treatment also depends on the stirring intensity of the milling bodies, on their number and size, and further on the intensity of the pumping operation of the disintegrator. In practice, the duration of treatment is selected on the basis of the diameter and the angular speed of rotation of the agitating disc, the required number, size and shape of openings on the circumference of the milling chamber, the dimensions and shape of the milling bodies and the initial dispersion of the material being treated.

According to the invention, the cylindrical milling chamber consists of two plane parallel end-walls with the cavities for liquid refrigerant circulation. One of the end walls 2 of the milling chamber 1 is provided with an opening 3 for feeding a suspension of the material being disintegrated. Mounted in the opening 3 is a frusto-conical pipe 4 terminating with a pipe connection 5 connected to a conduit 6 extending from a tank containing the material being disintegrated. Openings 8 for discharging the disintegrated material from the milling chamber 1 are arranged on the cylindrical surface of the milling chamber 1.

It is known that a total cross-sectional area of the discharge openings 8 determines the throughput capacity of the disintegrator as regards to the flow of suspension, and it will be apparent that the total cross-sectional area of the openings 8 should be selected by way of experiments.

According to the invention, it is contemplated to provide the openings 8 for discharging the disintegrated material in such a manner that their length is substantially greater than the width thereof. It is important that from three to twenty four of such openings should be uniformly distributed over the entire cylindrical surface of the milling chamber 1.

A manifold 9 is provided at the outer side of the cylindrical surface of the milling chamber 1 for collecting the material disintegrated in the milling chamber 1. An opening with a pipe 10 is provided in the manifold casing for discharging the disintegrated material from the disintegrator.

An agitator comprising a disc 11 is concentrically mounted in the milling chamber 1. The disc 11 has a central zone, i.e., a hub having a radius of about 0.3 of the disc radius. In order to provide for uniform distribution of the material being disintegrated over the entire volume of the milling chamber 1, openings 12 of an arbitrary shape are made in the central zone of disc 11.

It should be noted, however, that the total cross-sectional area of the openings 12 should be greater than one-half of the cross-sectional area of the pipe connection 5. This is required to provide uniform distribution of a suspension of the material being disintegrated to either side of disc 11.

According to the invention, disc 11 is made with an enlarged portion in the central zone to improve its rigidity at the point of fastening to a drive shaft 13. The material of the disc should be chemically inert and strong. These requirements are complied with when using, e.g. titanium-containing stainless steel. According to the invention, apertures, orifices or grooves are provided in the peripheral zone of disc 11 to intensify the agitation and disintegration of hardly destructible biological products, such as microbic cells of Saccharomyces cerevisise.

Another important component of the disintegrator comprises milling bodies 14 placed in the milling chamber 1. Depending on a required intensity of mechanical action exerted on the material being disintegrated, the bulk volume of the milling bodies 14 should be from 0.05 to 0.95 of the free space of the milling chamber 1. Thus, for disintegration of low-strength animal cells, the bulk volume of the milling bodies 14 is 0.1 of the free space of the milling chamber 1, whereas for disintegration of much more stronger yeast cells this volume is as great as 0.8 of the free space of the milling chamber.

The material of the milling bodies 14 should have a density equal to or about equal to that of the suspension of the material being disintegrated so as to provide an equilibrium state in a liquid medium, that is the state at which the archimides force applied to the body is equal to the weight thereof.

This material should be chemically inert.

We have found that the milling bodies 14 having a density equal to or about equal to that of the suspension of the material being disintegrated and having a size from 0.1 to 1.0 mm are uniformly distributed over the entire volume of the chamber and ensure the maximum efficiency or disintegration.

The material used to make the milling bodies 14 should be viscously elastic so that the zones of impact contact of the milling bodies 14 have the maximum area to soften the force and power conditions of the destruction process. Due to the viscous-elastic properties of the material of the milling bodies 14 they may be of cylindrical, ovoidal, spherical or plate-like shape.

The material of the milling bodies 14 should feature antifriction properties so that during the friction of the milling bodies with each other and with the surfaces of disc 11 and the milling chamber, a minimal amount of heat is released, whereby the thermomechanical degrading of the material being disintegrated is materially diminished.

According to the invention, the material of the milling bodies 14 may comprise;

polytetrafluoroethylene, density 2.14–2.25 g/cm$^3$,
polytetrafluorochlorethylene, density 2.08–2.16 g/cm$^3$,
polyethylene, density 0.92–0.97 g/cm$^3$,
polyethyleneterephthalate, density 1.33 g/cm$^3$,
polystyeren and styrene copolymers- block copolymers and graft copolymers (density, 1.05–1.06 g/cm$^3$), certain polyurethanes with a low content of OH group (density 1.17 g/cm$^3$), polyvinylacetals (density from 1.1. to 1.35 g/cm³), copolymers with a high contact (more than 75%) of vinylidene chloride, polyvinyl chloride (density 1.24–1.43 g/cm³), polycarbonates, such as diphenylpropane, polymetacrylate (density 1.045–1.187 g/cm³), isotactic polypropylene (density 0.90–0.92 g/cm³).

The space between the disc 11 and inner walls of the milling chamber 1 should be constant and equal to the thickness of 5–10 layers of the milling bodies 14 to provide for the most intensive agitation thereof. Referring to the above description, it should be noted that the size of the openings 8 for discharging the disintegrated material from the milling chamber 1 should to equal to 0.2–0.5 of the smallest dimension of the milling bodies 14. This ensures the retention of the milling bodies 14 within the milling chamber 1 and a perfect separation thereof from the disintegrated material. For replacement of the milling bodies 14, the milling chamber 1 has an opening 15 tightly sealed with a plug 16. The diameter of the opening 15 should permit a free passage of the milling bodies 14 therethrough. It is contemplated to arrange the opening 15 in one of the end walls of the cylindrical milling chamber 1 with a maximum possible spacing from the center thereof.

The disintegrator according to the invention functions as follows. Milling bodies 14, e.g. of polyethylene in the form of cylinders 0.2 mm in diameter and 0.5 mm height are charged through the opening 15 into the milling chamber 1, thermostatically controlled at 4° C, in an amount sufficient to fill the milling chamber 1, or to fill the chamber 1 by 0.9 of the volume thereof.

The agitator disc 11 is rotated by a drive 17 so that the rotational speed at the edge of the disc 11 can attain 35 m/s. Then a suspension is red under gravity from a tank 7 thermostatically controlled at 4° C with the surface level of the suspension located above the frusto-conical pipe 4 of the disintegrator, through the inlet pipe connection 5 and the frusto-conical pipe 4 to the central zone of the disc 11 to be uniformly distributed over the entire volume of the milling chamber 1.

During rotation of the disc 11 in the milling chamber 1 filled with the milling bodies 14 and suspension being treated, hydraulic pressure in the vicinity of the central zone of disc 11 decreases under the action of centrifugal forces, while the pressure at the peripheral zone of disc 11 increases. This provides a suction effect sufficient to pump the suspension of the material being disintegrated of a viscosity from 1 to 500 cP at +4° C through the internal space of the milling chamber 1.

In the milling chamber 1, the milling bodies 14 entrained by the flow of the suspension being pumped through are subjected to the action of centrifugal and impact forces developed upon striking of the milling bodies 14 against each other, against the agitator disc 11, and the walls of the milling chamber 1. There are no buoyancy forces acting on the milling bodies 14 since their density is equal to the density of the suspension of the material being disintegrated.

The equilibrium state of the milling bodies 14 in the liquid medium enables the elimination of the adverse effect of centrifugal forces on the intensity of agitation of the milling bodies 14 in the milling chamber 1, such that highly intensive disintegration of the material is achieved at any rotational speed of the agitator disc from 1.0 to 50 m/s.

The rotation of the agitator disc 11 results in the relative sliding of layers of the milling bodies 14 both within the mass of the milling bodies and in the space betwenn this mass and the walls of the milling chamber. Therefore, the disintegration of particles of the material being disintegrated takes place in the zones of sliding impact interaction of the milling bodies 14.

We have found that an optimal spacing between the peripheral surface of disc 11 and the inner surface of the milling chamber 1 is equal to an average thickness of 5–10 layers of milling bodies. A greater spacing results in a considerable decrease in the heat removed by the walls of the milling chamber 1. If the spacing is smaller than the thickness of the five layers of the milling bodies 14, the mechanical efficiency of the disintegrator is materially impaired since the agitation of the milling bodies 14 in such a space is hampered. In the disintegrator according to the present invention, disintegration of particles of the material being treated occurs in the zones of sliding contact of the milling bodies 14 (made of a viscously elastic antifriction material, such as polyethylene), mainly due to the action of shear forces. The suspension of the disintegrated material passes through the intensively agitated layer of the milling bodies 14. It then passes through slit-like openings 8 retaining the milling bodies 14 into the manifold 9 passes through the discharge opening 10 into a flexible hose 18, and finally into a tank 19 for receiving the disintegrated material thermostatically controlled at 4° C.

After the treatment of cortisone acetate powder, 95% of the powder was disintegrated to a particle size less than 0.5μm. After the treatment of 10% aqueous suspension of Saccharomyces cerevisial, 98% of the cells were disintegrated.

Disintegration of these materials takes place at a most favorable temperature due to the fact that the employment of the milling bodies 14 made of a viscously elastic antifriction material enables a substantial reduction of heat loss. The provision of the thermostatically controlled milling chamber 1 in the form of a cylinder having a width/diameter ratio within the range of 1:10 to 1:59 also contributes to the disintegration conditions characterized by an intensive heat removal because all the material being disintegrated is treated adjacent to permanently cooled walls of the milling chamber 1.

It should be added, that with the electric power consumption of 0.8 kW per hour, 100 l of 10–50% aqueous solution of materials such as for example, cortisone acetate with particle sizes ranging from 15 to 150μm and microorganisms such as Saccharomyces cerevisial can be treated during one hour.

What is claimed is:

1. A disintegrator comprising a: cylindrical milling chamber having a width substantially smaller than the diameter thereof; said chamber having two end walls; an opening for feeding into said chamber a suspension of the material being disintegrated and located at the center of one of said end walls fo the milling chamber; openings for discharging from said chamber the suspension of disintegrated material in the cylindrical surface of said milling chamber; an agitator mounted at the center of said milling chamber and concentrically therewith; milling bodies made of a material having a density corresponding to the density of the suspension material being disintegrated, the space between said agitator and the inner walls of said chamber being constant and substantially equal to the thickness of 5 to 10 layers of said milling bodies.

2. A disintegrator as defined in claim 1 wherein the disintegrated material has a particle size substantially less than 0.5μm.

3. A disintegrator as defined in claim 2 wherein the material to be disintegrated is subjected to treatment for a period of $5 \times 10^{-2}$ to 1.0 second.

4. A disintegrator comprising: a cylindrical milling chamber having a width substantially smaller than the diameter thereof; said chamber having two end walls: an opening for feeding into said chamber a suspension of the material being disintegrated and located at the center of one of said end walls of the milling chamber; openings for discharging from said chamber the suspension of disintegrated material in the cylindrical surface of said milling chamber, an agitator mounted at the center of said milling chamber and concentrically therewith; milling bodies made of a material having a density corresponding to the density of the suspension material being disintegrated, the space between said agitator and the inner walls of said chamber being constant and substantially equal to the thickness of 5 to 10 layers of said milling bodies; the ratio of the width of said milling chamber to the diameter thereof being from about 1:10 to 1:50.

5. A disintegrator comprising a thermostatically temperature controlled cylinder milling chamber having a width substantially smaller than the diameter thereof; said chamber having two end walls; an opening for feeding into said chamber a suspension of the material being disintegrated and located at the center of one of said end walls of the milling chamber; openings for discharging from said chamber the suspension of disintegrated material in the cylindrical surface of said milling chamber; an agitator mounted at the center of said milling chamber and concentrically therewith; milling bodies made of a material having a density corresponding to the density of the suspension material being disintegrated, the space between said agitator and the inner walls of said chamber being constant and substantially equal to the thickness of 5 to 10 layers of said milling bodies, said milling bodies being placed in substantially 5 to 10 layers in said milling chamber center between the chamber walls and said agitator; said milling bodies being made of a chemically inert anti-friction material.

6. A disintegrator comprising a thermostatically temperature controlled cylindrical milling chamber having a width substantially smaller than the diameter thereof; said chamber having two end walls; an opening disintegrated and located at the center of one of said end walls of the milling chamber; openings for discharging from said chamber the suspension of disintegrated material in the cylindrical surface of said milling chamber; an agitator mounted at the center of said milling chamber and concentrically therewith; milling bodies made of a material having a density corresponding to the density of the suspension material being disintegrated, the space between said agitator and the inner walls of said chamber being constant and substantially equal to the thickness of 5 to 10 layers of said milling bodies, said milling bodies being placed in substantially 5 to 10 layers in said milling chamber center between the chamber walls and said agitator; the disintegrated material being a particle size substantially less than 0.5 um; the material to be disintegrated being subjected to treatment for a period of $5 \times 10^{-2}$ to 1.0 second; said milling bodies having a bulk volume within the range of substantially 0.05 to 0.95 of the free space of said milling chamber.

* * * * *